US012178325B2

(12) United States Patent
Li et al.

(10) Patent No.: US 12,178,325 B2
(45) Date of Patent: Dec. 31, 2024

(54) OTTOMAN LINKAGE DEVICE, FRAME BODY, AND SEAT

(71) Applicant: DEWERTOKIN TECHNOLOGY GROUP CO., LTD., Jiaxing (CN)

(72) Inventors: Long Li, Jiaxing (CN); Qiqi Ye, Jiaxing (CN); Liming Yang, Jiaxing (CN); Pengfei He, Jiaxing (CN); Bin Shen, Jiaxing (CN); Kangming Tao, Jiaxing (CN); Guowei Wang, Jiaxing (CN)

(73) Assignee: DEWERTOKIN TECHNOLOGY GROUP CO., LTD., Jiaxing (CN)

( * ) Notice: Subject to any disclaimer, the term of this patent is extended or adjusted under 35 U.S.C. 154(b) by 87 days.

(21) Appl. No.: 18/034,148

(22) PCT Filed: Nov. 5, 2021

(86) PCT No.: PCT/CN2021/128839

§ 371 (c)(1),
(2) Date: Apr. 27, 2023

(87) PCT Pub. No.: WO2022/105618

PCT Pub. Date: May 27, 2022

(65) Prior Publication Data

US 2023/0380597 A1 Nov. 30, 2023

(30) Foreign Application Priority Data

Nov. 19, 2020 (CN) ..... 202011301484.5
Nov. 19, 2020 (CN) ..... 202022693664.4

(51) Int. Cl.
*A47C 1/031* (2006.01)
*A47C 1/0355* (2013.01)

(52) U.S. Cl.
CPC ..... *A47C 1/0355* (2013.01)

(58) Field of Classification Search
CPC ..... A47C 1/0355; A47C 3/027; A47C 1/0345; A47C 16/02
See application file for complete search history.

(56) References Cited

U.S. PATENT DOCUMENTS 2,888,978 A * 6/1959 Schliephacke ..... A47C 1/0355 297/85 R
5,588,710 A 12/1996 Wiecek
(Continued)

FOREIGN PATENT DOCUMENTS

CN 102793396 A 11/2012
CN 203314481 U 12/2013
(Continued)

OTHER PUBLICATIONS

International Search Report for corresponding application PCT/CN2021/128839 filed Nov. 5, 2021; Mail date Jan. 26, 2022.
(Continued)

*Primary Examiner* — Shin H Kim
(74) *Attorney, Agent, or Firm* — CANTOR COLBURN LLP

(57) ABSTRACT

Provided are an ottoman linkage device, a frame body, and a seat. The ottoman linkage device includes an upper link, a lower link, a middle ottoman link, a first front ottoman link, a second front ottoman link, a first connection link, a second connection link, a front ottoman bracket, and a middle ottoman bracket. The upper link or the lower link is rotatable under a driving force to make the ottoman linkage device unfold or fold. By changing the length of the first connection link and the length of the second connection link, the magnitude of the driving force of the first connection link can be adjusted.

20 Claims, 2 Drawing Sheets

(56) References Cited

U.S. PATENT DOCUMENTS

| | | | | |
|---|---|---|---|---|
| 8,297,693 | B2 * | 10/2012 | Hoffman | A47C 3/0255 297/85 M |
| 9,839,297 | B2 * | 12/2017 | Lawson | A47C 7/503 |
| 10,448,745 | B2 * | 10/2019 | Lawson | A47C 7/5068 |
| 10,512,333 | B2 * | 12/2019 | Lawson | A63J 3/00 |
| 10,842,273 | B2 * | 11/2020 | Fei | A47C 1/0355 |
| 11,140,990 | B2 * | 10/2021 | Sun | A47C 1/024 |
| 11,638,483 | B2 * | 5/2023 | Sun | A47C 1/03211 297/75 |
| 2005/0137274 | A1 * | 6/2005 | Ko | A61K 31/775 521/64 |
| 2012/0119547 | A1 * | 5/2012 | Hoffman | A47C 3/0255 297/84 |
| 2018/0064255 | A1 * | 3/2018 | Lawson | A47C 7/5068 |

FOREIGN PATENT DOCUMENTS

| | | | |
|---|---|---|---|
| CN | 104138161 | A | 11/2014 |
| CN | 205457362 | U | 8/2016 |
| CN | 106132246 | A | 11/2016 |
| CN | 108771372 | A | 11/2018 |
| CN | 209331482 | U | 9/2019 |
| CN | 112244552 | A | 1/2021 |
| CN | 213720905 | U | 7/2021 |
| JP | 2014133451 | A | 7/2014 |

OTHER PUBLICATIONS

Chinese Office Action for corresponding application 202011301484.5; Mail date Aug. 20, 2024.

* cited by examiner

OTTOMAN LINKAGE DEVICE, FRAME BODY, AND SEAT

CROSS-REFERENCE TO RELATED APPLICATION

This is a National stage application, filed under 37 U.S.C. 371, of International Patent Application NO. PCT/CN2021/128839, filed on Nov. 5, 2021, which is based on and claims priority to Chinese Patent Application Nos. 202011301484.5 and 202022693664.4 filed with the China National Intellectual Property Administration (CNIPA) on Nov. 19, 2020, the disclosures of which are incorporated herein by reference in their entireties.

TECHNICAL FIELD

The present disclosure relates to the technical field of seats, for example, an ottoman linkage device, a frame body, and a seat.

BACKGROUND

Many seats currently on the market include retractable recliner cushions. The recliner cushions, when unfolded, enable people to lie down and have a rest, and when folded, serve as normal seats. However, these seats cannot be used by people of different heights due to the limitations of structure and the fixed distance between the footrest and recliner cushion. Moreover, the driving force for unfolding these seats is fixed and unadjustable, often leading to inflexible stretching and retraction of the recliner cushions.

SUMMARY

In a first aspect, the present disclosure provides an ottoman linkage device. The ottoman linkage device includes an upper link, a lower link, a middle ottoman link, a first front ottoman link, a second front ottoman link, a first connection link, a second connection link, a front ottoman bracket, and a middle ottoman bracket. The lower link, the middle ottoman link, and the middle ottoman bracket are sequentially hinged. The upper link, the first front ottoman link, and the middle ottoman bracket are sequentially hinged. The middle ottoman link is hinged to the upper link. The second front ottoman link is hinged between the first front ottoman link and the front ottoman bracket. The first connection link is hinged to the second connection link. The first connection link is hinged to the front ottoman bracket. The second connection link is hinged to the first front ottoman link. The middle ottoman bracket is hinged to the first connection link.

In a second aspect, the present disclosure provides a frame body. The frame body includes a fixed assembly, a movable link assembly, and the ottoman linkage device described above. The movable link assembly is connected to the fixed assembly. The ottoman linkage device is hinged to the movable link assembly.

In a third aspect, the present disclosure further provides a seat including the frame body described above.

REFERENCE LIST

Figure 1:
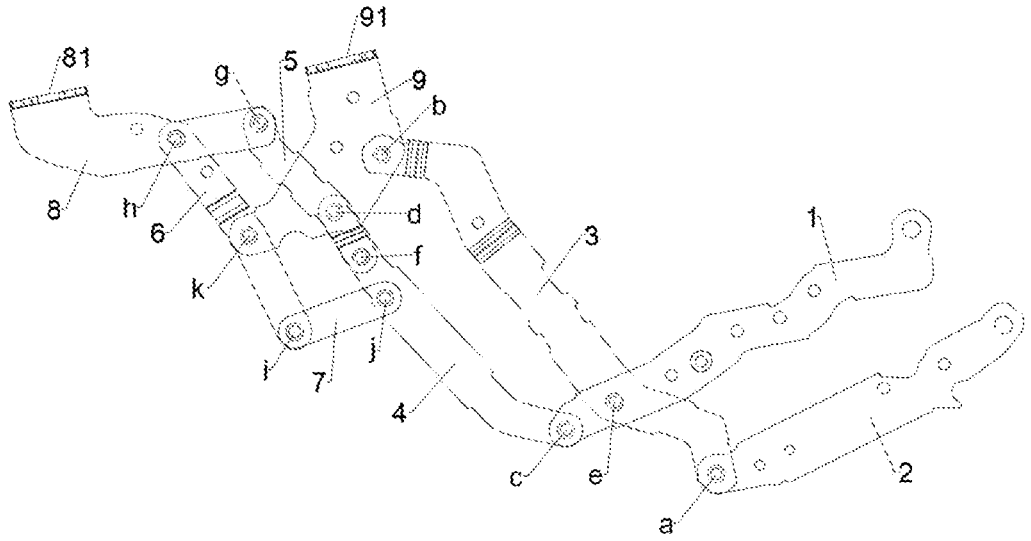
FIG. 1 is a view illustrating the structure of an ottoman linkage device according to an embodiment of the present disclosure.
Figure 2:
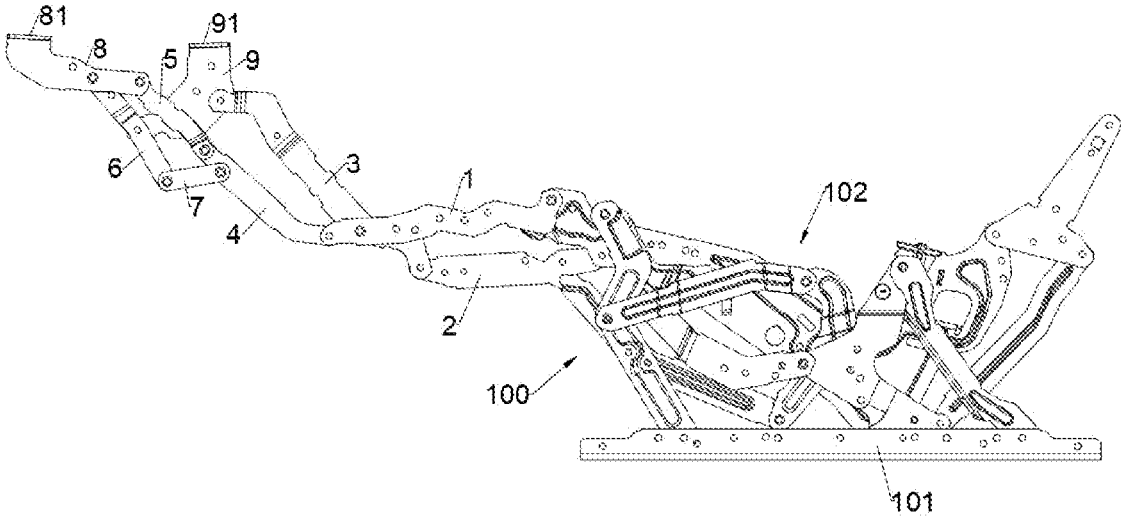
FIG. 2 is a view illustrating the structure of a frame body when the ottoman linkage device is unfolded according to an embodiment of the present disclosure.

100 frame body
101 fixed assembly
102 movable link assembly
1 upper link
2 lower link
3 middle ottoman link
4 first front ottoman link
5 second front ottoman link
6 first connection link
7 second connection link
8 front ottoman bracket
81 front ottoman cushion attachment platform
9 middle ottoman bracket
91 recliner cushion attachment platform

DETAILED DESCRIPTION

Technical solutions in embodiments of the present disclosure are described in conjunction with drawings herein. Generally, the components of embodiments of the present disclosure described and illustrated in the drawings herein may be arranged and designed through various configurations.

Therefore, the description of the embodiments of the present disclosure shown in the drawings herein is not intended to limit the scope of the present disclosure, but merely illustrates the selected embodiments of the present disclosure.

It is to be noted that similar reference numerals and letters indicate similar items in subsequent drawings. Therefore, once a certain item is defined in one drawing, the item needs no more definition and explanation in the subsequent drawings.

In the description of the present disclosure, it is to be noted that the orientational or positional relationships indicated by terms "above", "below", "left", "right", "vertical", "horizontal", "inside", "outside" and the like are based on the orientational or positional relationships illustrated in the drawings or the orientational or positional relationship that products of the present disclosure are usually used in. These orientations or position relations are intended only to facilitate and simplify description of the present disclosure, and not to indicate or imply that a device or element referred to must have such specific orientations or must be configured or operated in such specific orientations. Thus, these orientations or position relations are not to be construed as limiting the present disclosure. Moreover, terms "first", "second" and "third" are merely for distinguishing the description and are not to be construed as indicating or implying relative importance. In the description of the present disclosure, unless otherwise noted, a term "a plurality of" or "multiple" means two or more.

In the description of the present disclosure, it is to be noted that unless otherwise expressly specified and limited, a term "configured" or "connected" is to be construed in a broad sense, for example, as securely connected, detachably connected, or internally connected; or mechanically connected or electrically connected. For those of ordinary skill in the art, specific meanings of the preceding terms in the present disclosure may be construed according to specific situations.

In the present disclosure, unless otherwise expressly specified and limited, when a first feature is described as "above" or "below" a second feature, the first feature and the second feature may be in direct contact or be in contact via another feature between the two features instead of being in direct contact. Moreover, when the first feature is "on", "above", or "over" the second feature, the first feature is right on, above, or over the second feature, or the first feature is obliquely on, above, or over the second feature, or the first feature is simply at a higher level than the second feature. When the first feature is "under", "below", or "underneath" the second feature, the first feature is right under, below, or underneath the second feature, or the first feature is obliquely under, below, or underneath the second feature, or the first feature is simply at a lower level than the second feature.

Embodiments of the present disclosure are described below. Examples of the embodiments are illustrated in the drawings, where the same or similar reference numerals indicate the same or similar elements or elements having the same or similar functions. The embodiments described below with reference to the drawings are illustrative, only for explaining the present disclosure, and not to be construed as limiting the present disclosure.

As show in FIGS. 1 to 4, embodiments provide an ottoman linkage device, including an upper link 1, a lower link 2, a middle ottoman link 3, a first front ottoman link 4, a second front ottoman link 5, a first connection link 6, a second connection link 7, a front ottoman bracket 8, and a middle ottoman bracket 9. The lower link 2, the middle ottoman link 3, and the middle ottoman bracket 9 are sequentially hinged. The upper link 1, the first front ottoman link 4, and the middle ottoman bracket 9 are sequentially hinged. The middle ottoman link 3 is hinged to the upper link 1. The second front ottoman link 5 is hinged between the first front ottoman link 4 and the front ottoman bracket 8. The first connection link 6 is hinged to the second connection link 7, and the first connection link 6 and the second connection link 7 are respectively hinged to the front ottoman bracket 8 and the first front ottoman link 4 (for example, the first connection link 6 is hinged to the front ottoman bracket 8, and the second connection link 7 is hinged to the first front ottoman link 4). The middle ottoman bracket 9 is hinged to the first connection link 6. The upper link 1 or the lower link 2 is rotatable under a driving force and capable of driving a linkage of the middle ottoman link 3, the first front ottoman link 4, the second front ottoman link 5, the first connection link 6, the second connection link 7, the front ottoman bracket 8, and the middle ottoman bracket 9 to make the ottoman linkage device unfold or fold.

One end of the first front ottoman link 4 is hinged to the upper link 1. Another end of the first front ottoman link 4 is hinged to the middle ottoman bracket 9. A hinge point of the second front ottoman link 5 and the first front ottoman link 4 is between hinge points at two ends of the first front ottoman link 4. One end of the first connection link 6 is hinged to the front ottoman bracket 8. Another end of the first connection link 6 is hinged to the second connection link 7. A hinge point of the middle ottoman bracket 9 and the first connection link 6 is between hinge points at two ends of the first connection link 6.

For example, one end of the middle ottoman link 3 is hinged to the lower link 2 through a hinge point a. The other end of the middle ottoman link 3 is hinged to the middle ottoman bracket 9 through a hinge point b. One end of the first front ottoman link 4 is hinged to the upper link 1 through a hinge point c. The other end of the first front ottoman link 4 is hinged to the middle ottoman bracket 9 through a hinge point d. The middle ottoman link 3 is hinged to the upper link 1 through a hinge point e. One end of the second front ottoman link 5 is hinged to the first front ottoman link 4 through a hinge point f. The other end of the second front ottoman link 5 is hinged to the front ottoman bracket 8 through a hinge point g. One end of the first connection link 6 is hinged to the front ottoman bracket 8 through a hinge point h. The other end of the first connection link 6 is hinged to one end of the second connection link 7 through a hinge point i. The other end of the second connection link 7 is hinged to the first front ottoman link 4 through a hinge point j. The hinge point f is between the hinge point d and the hinge point j. One end of the middle ottoman bracket 9 is hinged to the first connection link 6 through a hinge point k between the hinge point h and the hinge point i. It can be understood that various hinge forms may be adopted between hinge points of multiple links of the ottoman linkage device, such as pin shafts, rivets, bearings, and a combination of bolts and nuts. Any other suitable connection form known in the furniture manufacturing industry may also be adopted.

In an embodiment, the first front ottoman link 4, the middle ottoman bracket 9, the middle ottoman link 3, and the upper link 1 form a large quadrilateral, which can also be understood that the links between hinge points b, d, c, and e form a four-link mechanism of a large quadrilateral structure. The second front ottoman link 5, the front ottoman bracket 8, the first connection link 6, and the second connection link 7 form a small quadrilateral, which can be understood that the links between hinge points f, g, h, and i form a four-link mechanism of a small quadrilateral structure. In this embodiment, the driving member of the large quadrilateral structure is the upper link 1. When the driving force is transmitted to the middle ottoman bracket 9 through the linkage link, relative to the middle ottoman bracket 9, the first front ottoman link 4 is the driving member. The first front ottoman link 4 is linked with the first connection link 6 through the second connection link 7 so that the first connection link 6 becomes the driving member in the small quadrilateral structure and drives the front ottoman bracket 8 to move. The second front ottoman link 5 is a driven member. By changing the length of the first connection link 6 and the length of the second connection link 7, the magnitude of the driving force of the first connection link 6 can be adjusted, enabling smoother stretching and retraction of the ottoman linkage device. By adopting the first front ottoman link 4 and second front ottoman link 5 that are split from each other, the length of the second front ottoman link 5 can be increased in cooperation with the first connection link 6 and the second connection link 7. In this manner, the deformation scope of the small quadrilateral structure is larger, and at the same time, the operation of the middle ottoman bracket 9 is not affected, thereby increasing the distance between the front ottoman bracket 8 and the middle ottoman bracket 9 and expanding the application scope of the ottoman linkage device. In an embodiment, the height of a hinge point of the second front ottoman link 5 and the front ottoman bracket 8 is lower than the height of the top surface of a recliner cushion attachment platform 91. The highest point of the movement trajectory of the hinge point g does not exceed the top surface of the recliner cushion attachment platform 91 and thus does not interfere with the recliner cushion attachment platform 91, thereby ensuring the normal operation of the ottoman linkage device.

In an embodiment, one end of the middle ottoman bracket 9 is hinged to the first connection link 6, and another end of the middle ottoman bracket 9 is provided with a recliner cushion attachment platform 91. In an embodiment, one end of the front ottoman bracket 8 is hinged to the second front ottoman link 5, and another end of the front ottoman bracket 8 is provided with a front ottoman cushion attachment platform 81. In this embodiment, both the middle ottoman bracket 9 and the front ottoman bracket 8 are approximately L-shaped. In other embodiments, the middle ottoman bracket 9 and the front ottoman bracket 8 may also feature a V-shaped or arc-shaped structure.

In an embodiment, the recliner cushion attachment platform 91 and the front ottoman cushion attachment platform 81 are provided separately so that the gap between the two platforms can be extended.

In an embodiment, the positions of the recliner cushion attachment platform 91 and the front ottoman cushion attachment platform 81 can correspond to sofa cushions after the recliner cushion attachment platform 91 and the front ottoman cushion attachment platform 81 are added with a soft pack and packaged into a finished sofa.

In an embodiment, when the ottoman linkage device is unfolded, the recliner cushion attachment platform 91 is horizontally flush with the front ottoman cushion attachment platform 81, and when the ottoman linkage device is folded, the recliner cushion attachment platform 91 is vertically flush with the front ottoman cushion attachment platform 81. It can be understood that horizontally means a direction parallel to the horizontal plane, and vertically means a direction perpendicular to the horizontal direction.

The ottoman structure can also be recorded as a leg link structure.

Figure 3:
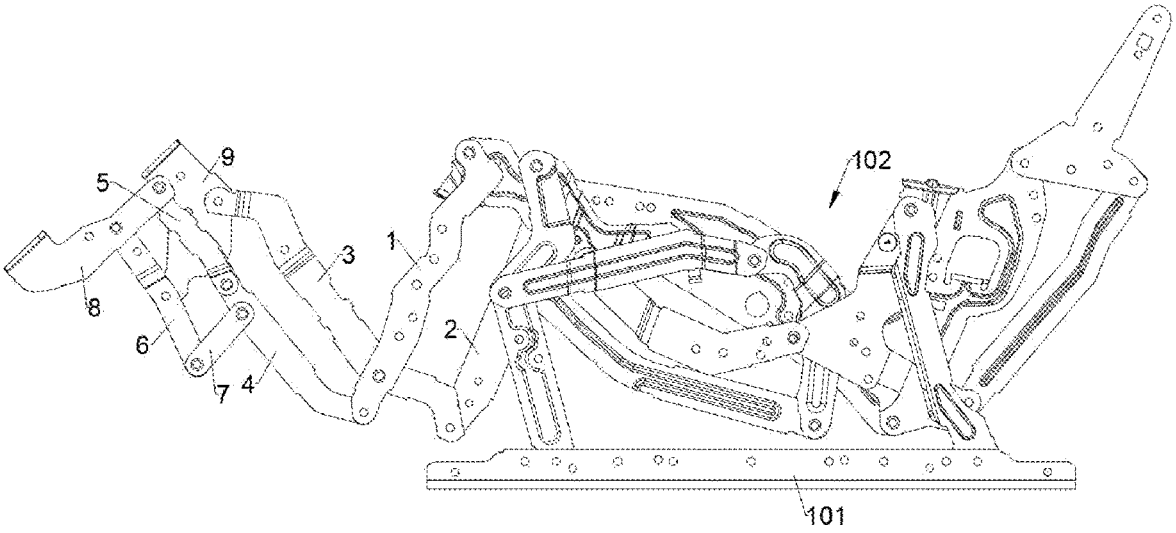
FIG. 3 is a view illustrating the structure of the frame body when the ottoman linkage device is half unfolded according to an embodiment of the present disclosure.
Figure 4:
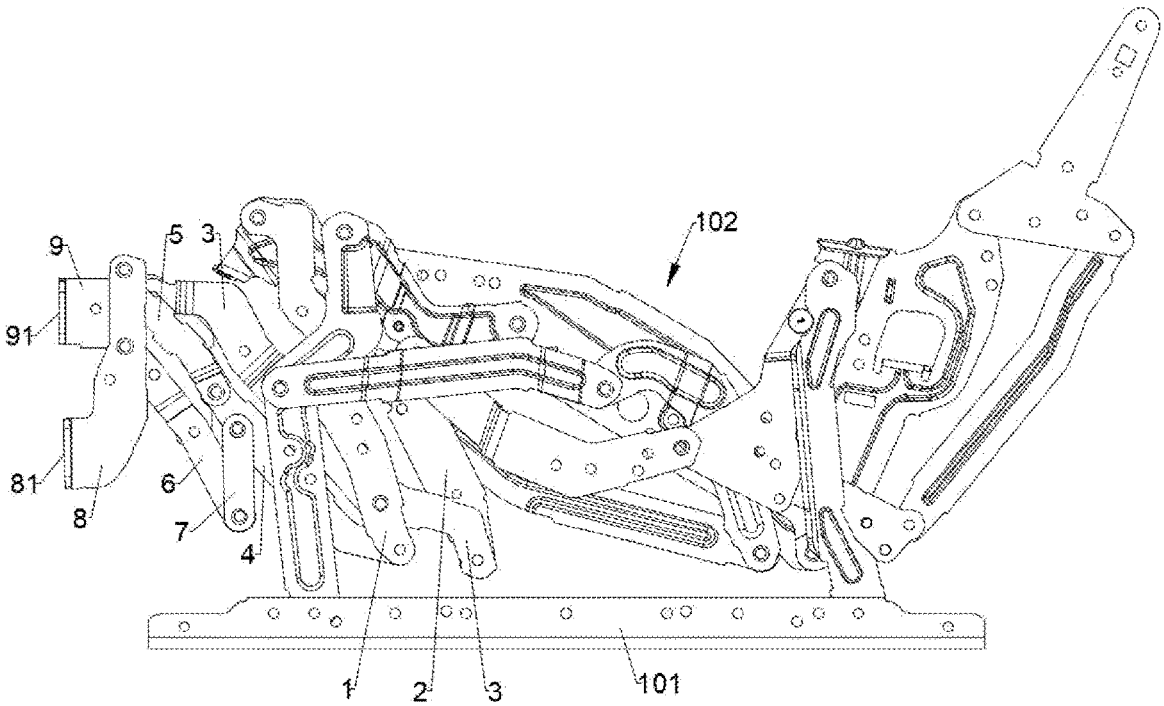
FIG. 4 is a view illustrating the structure of the frame body when the ottoman linkage device is folded according to an embodiment of the present disclosure.

This embodiment further provides a frame body shown in FIGS. 3 and 4, including a fixed assembly 101, a movable link assembly 102, and the ottoman linkage device described above. The movable link assembly 102 is connected to the fixed assembly 101, and the ottoman linkage device is hinged to the movable link assembly 102, that is, hinged to the movable link assembly 102 through the free ends of the upper link 1 and the lower link 2. In this embodiment, two ottoman linkage devices are roughly symmetrically arranged to provide more stable support. In other embodiments, one, three, four, or even more ottoman linkage devices may be provided, and the specific number may be selected as required.

For example, when the ottoman linkage device is unfolded, the recliner cushion attachment platform 91 is horizontally flush with the front ottoman cushion attachment platform 81 so that the user can lie down conveniently. When the ottoman linkage device is folded, the recliner cushion attachment platform 91 is vertically flush with the front ottoman cushion attachment platform 81, and the recliner cushion attachment platform 91 and the front ottoman cushion attachment platform 81 abuts against one side of the frame body 100 to provide more event space for the legs and feet.

For example, the fixed assembly 101 is a base.

In this embodiment, the structure of the frame body 100 may adopt a conventional frame body 100 in the related art in the field, and the structure thereof is not described herein.

This embodiment further provides a seat including the frame body 100 described above. In this embodiment, the frame body 100 is applied to a seat, which may be a sofa seat, a high-speed rail seat, an airplane seat, or the like applied to any suitable occasion. In other embodiments, the seat may also be a recliner for rest, or the like.

Embodiments of the present disclosure provide an ottoman linkage device capable of increasing the distance between the front ottoman bracket and the middle ottoman bracket. The driving force for unfolding the front ottoman bracket and the middle ottoman bracket can be adjusted.

Embodiments of the present disclosure provide a frame body. By applying the above ottoman linkage device, the frame body stretches and retracts more smoothly, and the applicable scope of the frame body is expanded.

Embodiments of the present disclosure provide a seat. By applying the above frame body, the comfort of use is improved, and the applicable scope of the seat is expanded.

It is to be understood by those skilled in the art that the present disclosure is not limited to the specific embodiments described herein.

What is claimed is:

1. An ottoman linkage device, comprising an upper link, a lower link, a middle ottoman link, a first front ottoman link, a second front ottoman link, a first connection link, a second connection link, a front ottoman bracket, and a middle ottoman bracket, wherein the lower link, the middle ottoman link, and the middle ottoman bracket are sequentially hinged, the upper link, the first front ottoman link, and the middle ottoman bracket are sequentially hinged, the middle ottoman link is hinged to the upper link, the second front ottoman link is hinged between the first front ottoman link and the front ottoman bracket, the first connection link is hinged to the second connection link, the first connection link is hinged to the front ottoman bracket, the second connection link is hinged to the first front ottoman link, and the middle ottoman bracket is hinged to the first connection link.

2. The ottoman linkage device of claim 1, wherein one end of the middle ottoman bracket is hinged to the first connection link, and another end of the middle ottoman bracket is provided with a recliner cushion attachment platform.

3. The ottoman linkage device of claim 2, wherein one end of the front ottoman bracket is hinged to the second front ottoman link, and another end of the front ottoman bracket is provided with a front ottoman cushion attachment platform.

4. The ottoman linkage device of claim 3, wherein, when the ottoman linkage device is unfolded, the recliner cushion attachment platform is horizontally flush with the front ottoman cushion attachment platform; and when the ottoman linkage device is folded, the recliner cushion attachment platform is vertically flush with the front ottoman cushion attachment platform.

5. The ottoman linkage device of claim 2, wherein a height of a hinge point of the second front ottoman link and the front ottoman bracket is lower than a height of a top surface of the recliner cushion attachment platform.

6. The ottoman linkage device of claim 1, wherein one end of the first front ottoman link is hinged to the upper link, another end of the first front ottoman link is hinged to the middle ottoman bracket, and a hinge point of the second front ottoman link and the first front ottoman link is between hinge points at two ends of the first front ottoman link.

7. The ottoman linkage device of claim 1, wherein one end of the first connection link is hinged to the front ottoman bracket, another end of the first connection link is hinged to the second connection link, and a hinge point of the middle ottoman bracket and the first connection link is between hinge points at two ends of the first connection link.

8. The ottoman linkage device of claim 1, wherein, the upper link or the lower link is rotatable under a driving force and capable of driving a linkage of the middle ottoman link, the first front ottoman link, the second front ottoman link, the first connection link, the second connection link, the front ottoman bracket, and the middle ottoman bracket to make the ottoman linkage device unfold or fold.

9. A frame body, comprising a fixed assembly, a movable link assembly, and the ottoman linkage device of claim 1, wherein the movable link assembly is connected to the fixed assembly, and the ottoman linkage device is hinged to the movable link assembly.

10. A seat, comprising the frame body of claim 9.

11. The ottoman linkage device of claim 2, wherein, the upper link or the lower link is rotatable under a driving force and capable of driving a linkage of the middle ottoman link, the first front ottoman link, the second front ottoman link, the first connection link, the second connection link, the front ottoman bracket, and the middle ottoman bracket to make the ottoman linkage device unfold or fold.

12. The ottoman linkage device of claim 3, wherein, the upper link or the lower link is rotatable under a driving force and capable of driving a linkage of the middle ottoman link, the first front ottoman link, the second front ottoman link, the first connection link, the second connection link, the front ottoman bracket, and the middle ottoman bracket to make the ottoman linkage device unfold or fold.

13. The ottoman linkage device of claim 4, wherein, the upper link or the lower link is rotatable under a driving force and capable of driving a linkage of the middle ottoman link, the first front ottoman link, the second front ottoman link, the first connection link, the second connection link, the front ottoman bracket, and the middle ottoman bracket to make the ottoman linkage device unfold or fold.

14. The ottoman linkage device of claim 5, wherein, the upper link or the lower link is rotatable under a driving force and capable of driving a linkage of the middle ottoman link, the first front ottoman link, the second front ottoman link, the first connection link, the second connection link, the front ottoman bracket, and the middle ottoman bracket to make the ottoman linkage device unfold or fold.

15. The ottoman linkage device of claim 6, wherein, the upper link or the lower link is rotatable under a driving force and capable of driving a linkage of the middle ottoman link, the first front ottoman link, the second front ottoman link, the first connection link, the second connection link, the front ottoman bracket, and the middle ottoman bracket to make the ottoman linkage device unfold or fold.

16. The ottoman linkage device of claim 7, wherein, the upper link or the lower link is rotatable under a driving force and capable of driving a linkage of the middle ottoman link, the first front ottoman link, the second front ottoman link, the first connection link, the second connection link, the front ottoman bracket, and the middle ottoman bracket to make the ottoman linkage device unfold or fold.

17. A frame body, comprising a fixed assembly, a movable link assembly, and the ottoman linkage device of claim 2, wherein the movable link assembly is connected to the fixed assembly, and the ottoman linkage device is hinged to the movable link assembly.

18. A frame body, comprising a fixed assembly, a movable link assembly, and the ottoman linkage device of claim 3, wherein the movable link assembly is connected to the fixed assembly, and the ottoman linkage device is hinged to the movable link assembly.

19. A frame body, comprising a fixed assembly, a movable link assembly, and the ottoman linkage device of claim 4, wherein the movable link assembly is connected to the fixed assembly, and the ottoman linkage device is hinged to the movable link assembly.

20. A frame body, comprising a fixed assembly, a movable link assembly, and the ottoman linkage device of claim 5, wherein the movable link assembly is connected to the fixed assembly, and the ottoman linkage device is hinged to the movable link assembly.

* * * * *